US006464017B1

(12) United States Patent
Chen

(10) Patent No.: US 6,464,017 B1
(45) Date of Patent: Oct. 15, 2002

(54) TRANSMISSION MECHANISM FOR PNEUMATIC TOOL

(76) Inventor: Li Chen Chen, No. 50, Chien Tsun East Rd., Taya Hsiang, Taichung Hsien (TW)

( * ) Notice: Subject to any disclaimer, the term of this patent is extended or adjusted under 35 U.S.C. 154(b) by 0 days.

(21) Appl. No.: 10/132,270

(22) Filed: Apr. 26, 2002

(51) Int. Cl.[7] ..... B25D 15/00
(52) U.S. Cl. ..... 173/93.5; 173/213
(58) Field of Search ..... 173/93, 93.5, 213, 173/218, 104

(56) References Cited

U.S. PATENT DOCUMENTS 3,533,479 A * 10/1970 Madsen ..... 173/93.5
4,313,505 A * 2/1982 Silvern ..... 173/93.5
5,012,878 A * 5/1991 Anderson ..... 173/213
5,370,194 A * 12/1994 Anderson ..... 173/213
6,135,212 A * 10/2000 Georgiou ..... 173/93
6,178,853 B1 * 1/2001 Huang ..... 173/93.5
6,283,226 B1 * 9/2001 Chen ..... 173/93.5

* cited by examiner

*Primary Examiner*—Scott A. Smith
(74) *Attorney, Agent, or Firm*—Rosenberg, Klein & Lee

(57) ABSTRACT

A transmission mechanism for pneumatic tool includes a casing holding a main body and a spring therein, and a transmission shaft axially projected from a top of the casing to extend through an oil-retaining shaft sleeve via a washer. The washer includes a boss portion. The casing is provided along an inner peripheral surface close to the top thereof with a locating groove, in which a C-shaped retaining ring is received to firmly bear against the washer around the boss portion and thereby hold the transmission shaft to the casing, enabling the whole transmission mechanism to be conveniently mounted in the pneumatic tool. The C-shaped retaining ring isolates impact force acted on the main body via the spring to prevent the main body from deformation and breaking, and prevents the washer from overly tight contact with the oil-retaining shaft sleeve to reduce a torque output of the transmission mechanism.

1 Claim, 4 Drawing Sheets

TRANSMISSION MECHANISM FOR PNEUMATIC TOOL

BACKGROUND OF THE INVENTION

The present invention relates to a transmission mechanism for pneumatic tool, and more particularly to a transmission mechanism that can be conveniently mounted into a housing of a pneumatic tool and enables the pneumatic tool to operate more smoothly.

A general pneumatic tool 100 usually includes a transmission mechanism 1' shown in FIGS. 1 and 2 show transmission mechanism 1' mainly includes a case main 1 in which a front cover bearing 19, a front cover 20, a main body 12, a sleeve seat 13, a sleeve 14, and a spring 15 are sequentially mounted from bottom to top, and a transmission shaft 18 having an end projected from a top of the casing to extend through an oil-retaining shaft sleeve 17 via a washer 16. When the entire transmission mechanism 1' has been mounted in a housing of the pneumatic tool 100, impact forces from two sources, namely, the transmission shaft 18, the washer 16, and the oil-retaining shaft sleeve 17, as well as the sleeve seat 13, the sleeve 14, and the casing 11, are transmitted to the main body 12, the front cover bearing 19, and the front cover 20 via two ends of the spring 15. When the pneumatic tool 100 is operated, each movement of the transmission mechanism 1' would cause an impact on the main body 12 to result in deformation or breaking thereof, and on the front cover bearing 19 and the front cover 20 to result in undesired loosening and deformation thereof.

When the transmission mechanism 1' rotates at a speed as high as 7000 rpm, the transmission shaft 18, the washer 16, and the oil-retaining shaft sleeve 17 are subjected to an action force of about 7 kgs from the spring 15 and therefore tightly contact with one another to result in reduced clearances and increased friction among them, as well as undesired heating of these components. The transmission mechanism 1' therefore has slowed rotational speed, increased noise, and reduced torque output.

It is noted the main body 12, the sleeve seat 13, the sleeve 14, the spring 15, the washer 16, the oil-retaining shaft sleeve 17, and the transmission shaft 18 of the above-described conventional transmission mechanism 1' for pneumatic tool 100 for assembled without being holding in place in the casing 11' by locating means. When the primarily assembled transmission mechanism 1' is to be mounted in this to be of the pneumatic tool 100, specially designed tools must be used. Moreover, the components of the primarily assembled transmission mechanism 1' tend to separate from one another during movement or transport before being mounted into the housing of the pneumatic tool 100, resulting in inconveniences and additional time and labor in subsequent assembling.

SUMMARY OF THE INVENTION

It is therefore a primary object of the present invention to provide an improved transmission mechanism for pneumatic tool that is able to overcome the problems of deformed or broken main body, over tightly contacted transmission shaft, washer, and oil-retaining shaft sleeve, and inconvenient assembling, so that the pneumatic tool could be more easily assembled and smoothly operated.

To achieve the above and other objects, the transmission mechanism for pneumatic tool according to the present invention mainly includes a casing that has an extended length to allow for the provision of a locating groove along an inner peripheral surface close to a top thereof for receiving a C-shaped retaining ring therein, and a washer that is provided at one side facing toward the top of the casing with a boss portion. After the transmission mechanism is assembled, the C-shaped retaining ring firmly bears against one side of the washer around the boss portion to hold the transmission shaft in place in the casing.

With the C-shaped retaining ring, (1) the whole transmission mechanism is highly stably assembled and can therefore be more conveniently mounted in the housing of the pneumatic tool without easily separated components during transport and mounting of the transmission mechanism; (2) undesired deformation or breaking of the main body caused by impact forces transmitted thereto from the transmission shaft via the spring can be eliminated; and (3) the washer is protected from overly tight contact with said oil-retaining shaft sleeve to avoid undesired friction, noise, heating, and reduced torque output of said transmission mechanism.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
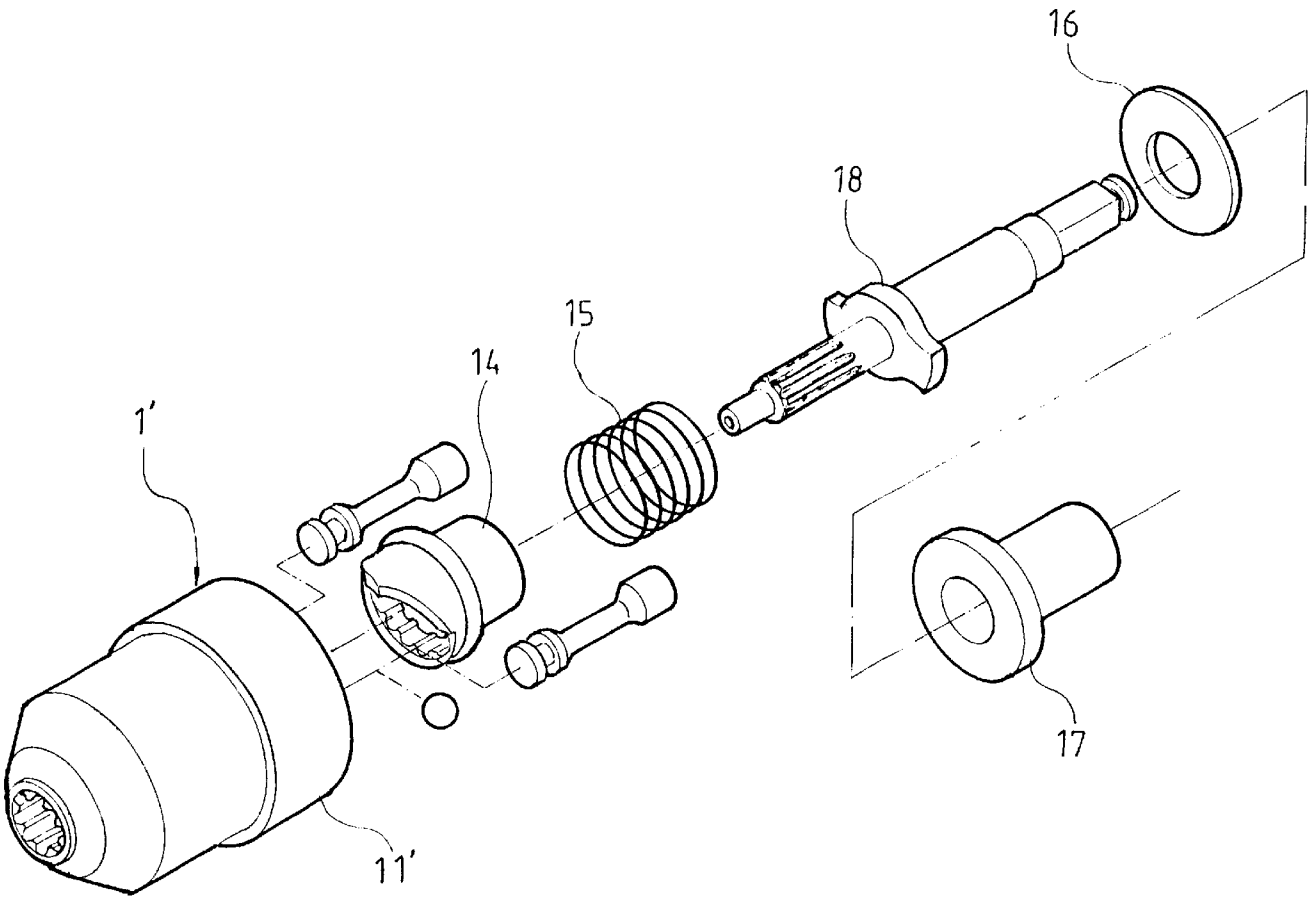
FIG. 1 PRIOR ART
FIG. 1 is an exploded perspective view of a conventional transmission mechanism for pneumatic tool.
Figure 2:
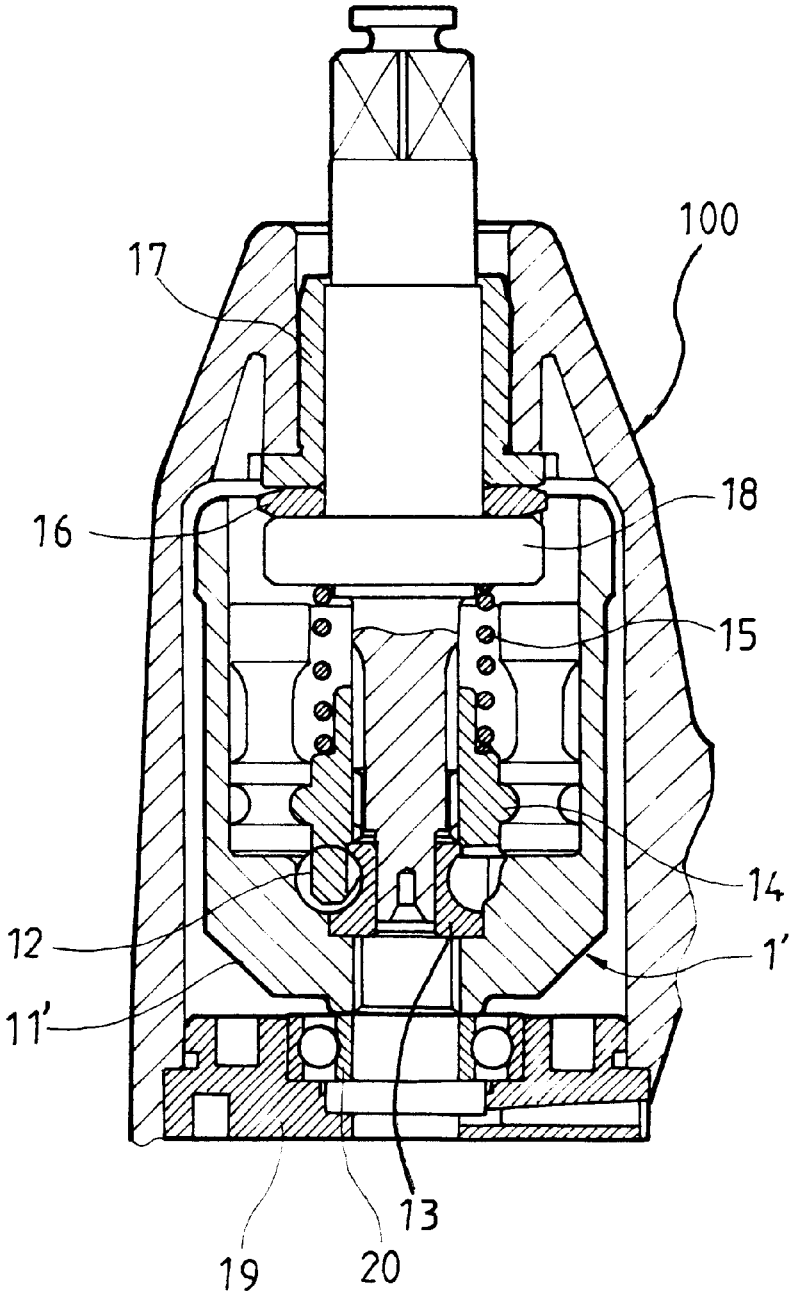
FIG. 2 PRIOR ART
FIG. 2 is a sectional view showing the conventional transmission mechanism for pneumatic tool of FIG. 1 having been assembled and mounted in a housing of a pneumatic tool.
Figure 3:
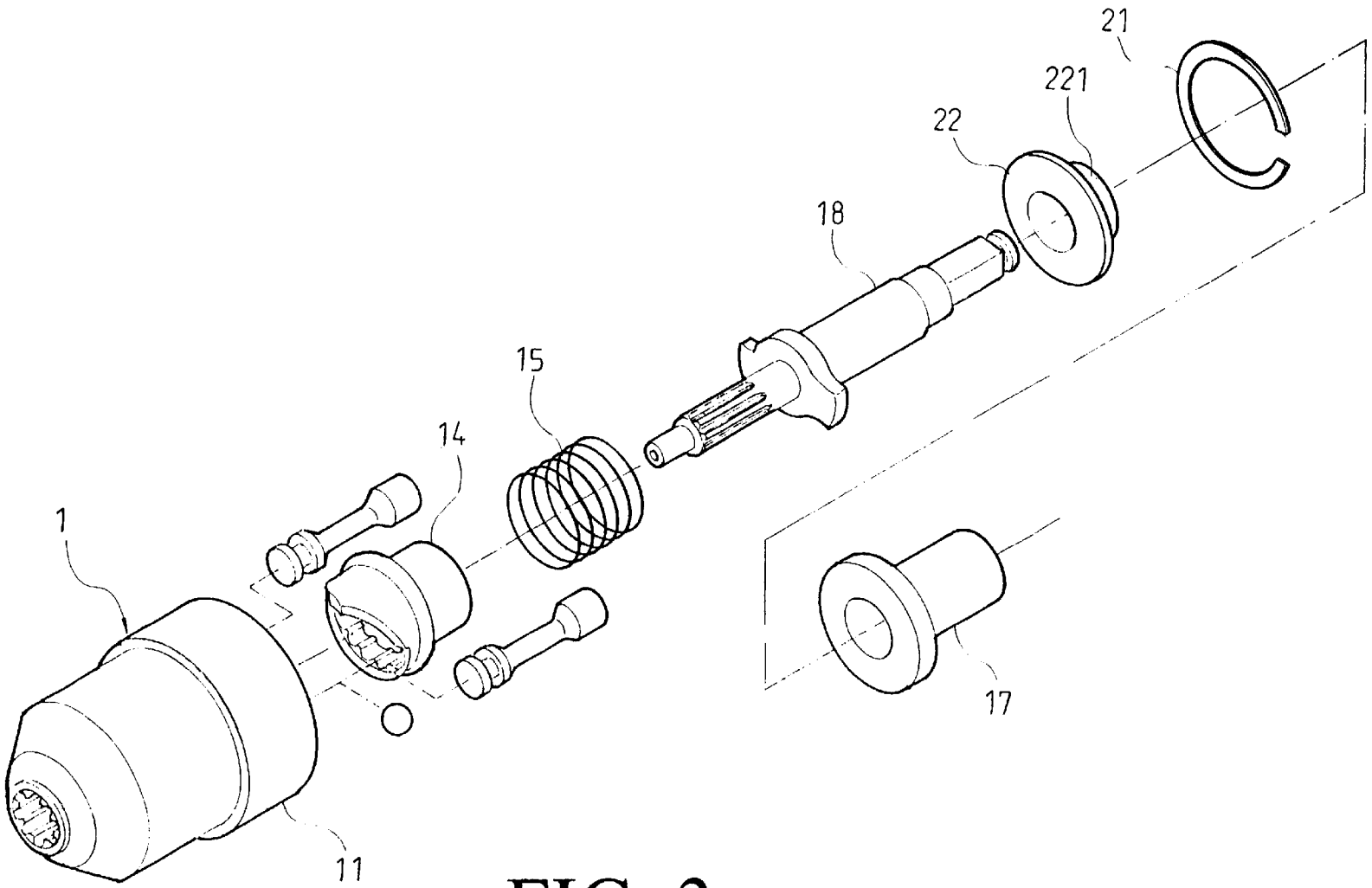
FIG. 3 is an exploded perspective view of a transmission mechanism for pneumatic tool according to the present invention.
Figure 4:
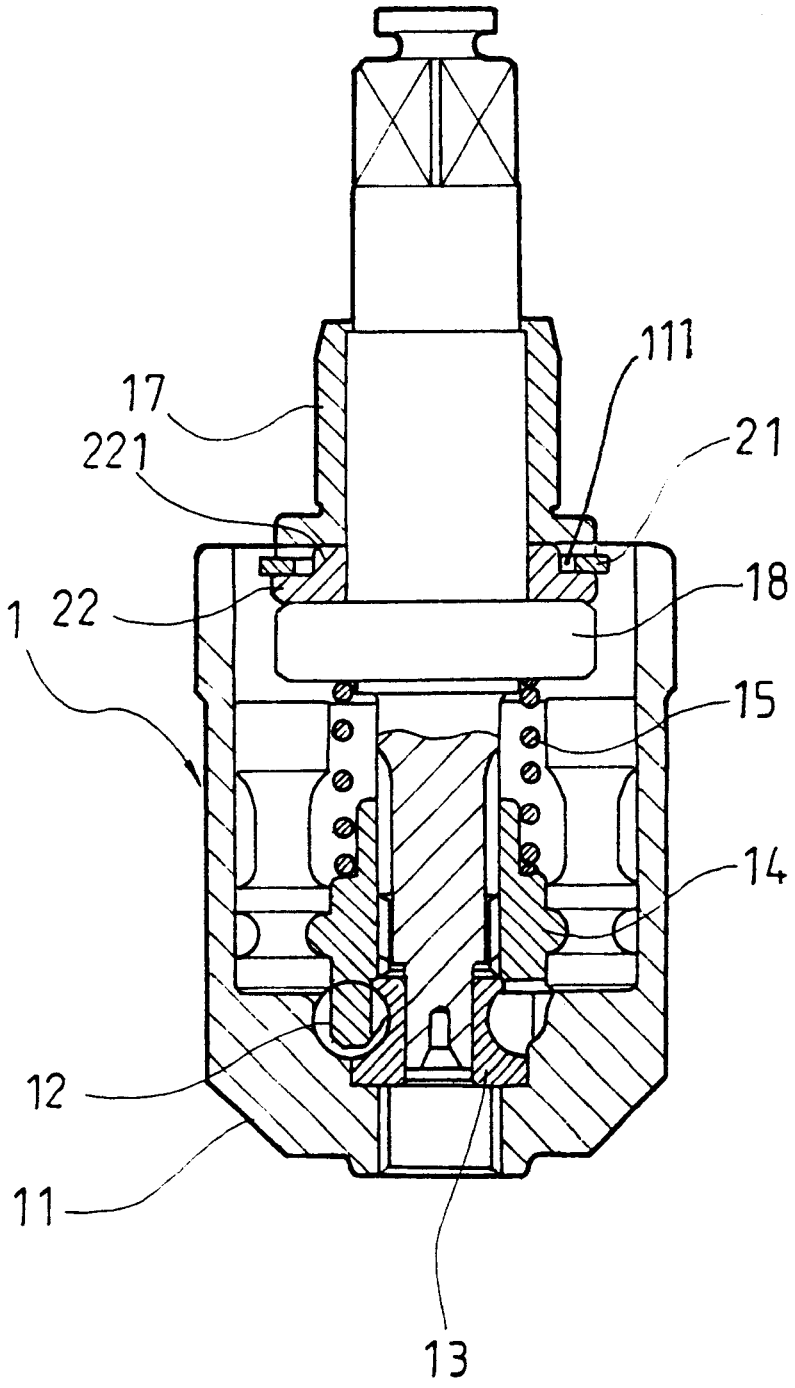
FIG. 4 is a sectional view showing the transmission mechanism for pneumatic tool of FIG. 3 having been assembled and mounted in a housing of a pneumatic tool.

Please refer to FIGS. 3 and 4 that are exploded perspective and assembled sectional views, respectively, of a transmission mechanism for pneumatic tool 1 according to the present invention. As in the conventional transmission mechanism for pneumatic tool 1', the transmission mechanism 1 of the present invention includes a main body 12, a sleeve seat 13, a sleeve 14, and a spring 15 that are sequentially mounted in a casing 11 from bottom to top thereof. The casing 11 has a length-extended top portion, as compared with the conventional casing 11', and is p, and is provid inner peripheral surface close to a top edge of the extended top portion with a locating groove 111. A C-shaped retaining ring 21 is received in the locating groove 111. The transmission mechanism for pneumatic tool 1 according to the present invention also includes a transmission shaft 18 that projects from the top edge of the casing 11 to extend through an oil-retaining shaft sleeve 17 via a washer 22. The washer 22 is different from the washer 16 in a boss portion 221 axially projected from one side of the washer 22 toward the top edge of the casing 11. When the transmission mechanism 1 is in a fully assembled state, the C-shaped retaining ring 21 firmly bears against one side of the washer 22 around the boss portion 221, as can be seen in FIG. 4. The assembled transmission mechanism 1 is then mounted in the housing of the pneumatic tool 100.

With the above arrangements, the transmission mechanism for pneumatic tool 1 according to the present invention includes at least the following advantages:

1. Since the C-shaped retaining ring 21 is received in the locating groove 111 on the casing 11 and firmly presses against one side of the washer 22 around the boss portion 221, it functions to locate the washer 22 and the transmission shaft 18 in place when the two latter members are assembled to the casing 11 This enables the whole transmission mechanism 1 to be a highly stable assembly that can be more conveniently mounted in the housing of the pneumatic tool 100.
2. With the C-shaped retaining ring 21 received in the locating groove 111 on the casing 11, undesired deformation or breaking of the main body 12 due to impact force transmitted thereto from the transmission shaft 18 via the spring 15 can be eliminated.
3. With the C-shaped retaining ring 21 received in the locating groove 111 on the casing 11, the washer 22 is protected from overly tight contact with the oil-retaining shaft sleeve 17 to sufficiently reduce undesired frictional wearing, noise, and heating of the transmission mechanism 1, and to advantageously increase the torque output thereof.
4. The C-shaped retaining ring 21 provides an isolation effect so that the transmission mechanism 1 is not subjected to a tight friction during operation of the pneumatic tool 100, making the latter easier for use.

What is claimed is:

1. A transmission mechanism for pneumatic tool, comprising a casing in which a main body, a sleeve seat, a sleeve, and a spring are sequentially assembled from bottom to top of said casing, and a transmission shaft axially mounted in and projected from a top of said casing to extend through an oil-retaining shaft sleeve via a washer; said washer being provided at one side facing toward the top of said casing with an axially projected boss portion; said casing having a top portion that is axially extended beyond said washer and is provided along an inner peripheral surface close to a top edge thereof with a locating groove for receiving a C-shaped retaining ring therein; and said C-shaped retaining ring firmly bearing against one side of said washer around said boss portion to locate said transmission shaft in place in said casing; whereby any impact force acted on said main body via said spring is isolated by said C-shaped retaining ring to protect said main body against deformation, and said washer is protected from overly tight contact with said oil-retaining shaft sleeve to avoid undesired friction, noise, heating, and reduced torque output of said transmission mechanism.

* * * * *